United States Patent [19]

Eberhart

[11] 4,142,383

[45] Mar. 6, 1979

[54] LIQUID FILLED SEALED GLASS ORNAMENT AND METHOD

[75] Inventor: Wolfgang R. Eberhart, Windsor, Canada

[73] Assignee: Eberhart Glass Blowing Ltd., Windsor, Canada

[21] Appl. No.: 825,294

[22] Filed: Aug. 17, 1977

[51] Int. Cl.[2] ..... A44C 25/00; A44C 17/00; A44C 17/02; B32B 31/14

[52] U.S. Cl. ..... 63/23; 63/31; 63/32; 156/145; 428/13; 428/28

[58] Field of Search ..... 63/31, 32, 1, 2, 23; 428/13, 14, 28, 35; 156/145

[56] References Cited

U.S. PATENT DOCUMENTS

| | | | |
|---|---|---|---|
| 909,467 | 1/1909 | Shaw | 63/2 UX |
| 1,421,329 | 6/1922 | Welch | 63/2 |
| 1,730,257 | 10/1929 | Welch | 63/32 |
| 1,741,692 | 12/1929 | Garaja | 428/13 |
| 1,827,695 | 10/1931 | Welch | 63/32 |
| 1,850,190 | 3/1932 | Welch | 63/32 |
| 1,912,602 | 6/1933 | Stonberg | 63/32 |
| 2,237,883 | 4/1941 | Lipic | 428/14 X |
| 3,461,010 | 8/1969 | Graham | 156/145 |

*Primary Examiner*—F. Barry Shay
*Attorney, Agent, or Firm*—Ian C. McLeod

[57] ABSTRACT

A method for the production of decorative objects by providing a viscous liquid and a particulate metal and/or mineral through an opening in a hollow transparent glass envelope and then bonding a cap over the opening with a resin impervious to said liquid is described. The refractive index of the viscous liquid and glass are approximately equal visually. The viscous liquid is preferably glycerine admixed with clear miscible solvents which reduce the viscosity depending upon the metal or mineral used. The liquid is provided through the opening in the hollow glass envelope without wetting the sides of the opening in a manner which leaves a gas (air) pocket inside the envelope adjacent the opening and above the liquid and then a cap is bonded over the opening adjacent the gas pocket. The decorative object is preferably in the form of jewelry, such as earrings or pendants.

17 Claims, 7 Drawing Figures

LIQUID FILLED SEALED GLASS ORNAMENT AND METHOD

DESCRIPTION OF THE INVENTION

The present invention relates to decorative objects formed of a glass envelope with a viscous liquid sealed inside the envelope which has a refractive index visually approximating that of the glass and with metal or mineral particles provided in the liquid. In particular the present invention relates to decorative objects in the form of jewelry.

PRIOR ART

The prior art has provided liquids inside of glass envelopes as decorative objects. Illustrative are U.S. Pat. Nos. 1,421,329; 1,730,827; 1,827,695; 1,850,190 and 1,912,609, all but the last patent having been issued to H. H. Welch. In this prior art the opening in the glass is sealed by heating which can easily cause the glass to crack, especially when high production is desired in the hands of relatively unskilled workers. Such decorative objects, in the form of jewelry or ornaments such as Christmas tree ornaments, paper weights and the like, are very desirable visually with particulate metals or minerals in the envelope.

OBJECTS

It is therefore an object of the present invention to provide decorative objects formed of a glass envelope with a cap bonded to an opening in the envelope which contains dense metal and mineral particles in a viscous liquid which gives the appearance of floating to the metals and minerals when they are agitated and which liquid has a refractive index visually approximating that of the glass so that the inside margins are less visible, so that the objects are very pleasing to the eye. It is further an object of the present invention to provide a method for the fabrication of such decorative objects which is simple and economical and which eliminates heat cracking of the glass. These and other objects will become increasingly apparent from the following description and the drawing.

IN THE DRAWINGS

GENERAL DESCRIPTION

The present invention relates to the method for the fabrication of a decorative object which comprises: providing a hollow glass envelope with a decorative portion and an opening with a roughened surface surrounding the opening remote from the decorative portion; providing a viscous liquid with particles of a metal or mineral or mixtures thereof inside the envelope through the opening without wetting the opening in an amount which leaves only a small gas pocket in the envelope adjacent the opening and above the liquid wherein the particles appear to float upon agitation in the liquid; and bonding a cap over the opening of the roughened surface with the gas pocket adjacent the opening. Preferably the envelope wall thickness is between 1.5 mm to 5.0 mm which is thicker than the prior art envelopes.

The glass surrounding the opening is roughened to provide a bondable surface. Otherwise the cap will loosen in the presence of the viscous liquid. Preferably a conical grinder is pressed against the outside of the tapered opening, since this provides concentric ring grooves parallel to the opening which effectively lock the cap on the envelope by means of the resin. Other mechanical or chemical means, such as hydrofluoric acid, can be used to roughen the surface. Preferably an epoxy resin is used to bond the cap to the roughened surface; however, other resin bonding agents, which are impervious to the viscous liquid, can be used.

The viscous liquid which has been found to be most suitable for the present invention is glycerol (glycerine) which visually has a refractive index approximating that of glass, preferably diluted with a low viscosity, miscible solvent so as to be injectible through a needle. Mineral oil can also be used. The particles of metal or mineral should appear to float upon agitation in the viscous liquid. Where flaked metals or minerals, such as gold or silver, are provided in the envelope which tend to float in the liquid more readily, the glycerine is mixed with a substantial amount (more than 50% by volume) of water and ethyl alcohol. Where larger metal or mineral particles such as opals, rubies or diamonds are provided in the envelope, a substantial amount of glycerine is used to increase the viscosity of the liquid.

SPECIFIC DESCRIPTION

Figure 1:
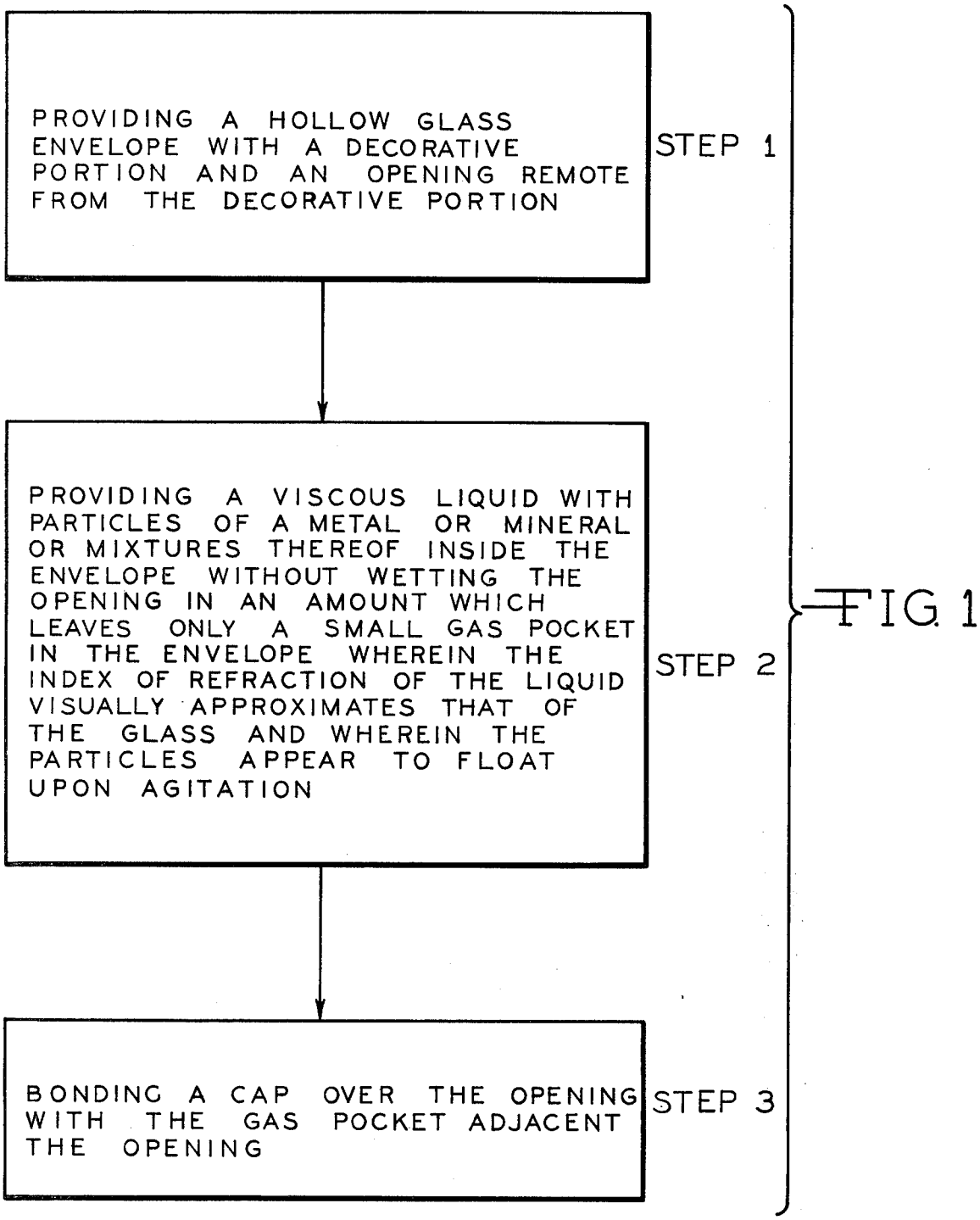
FIG. 1 is a flow diagram of the method of the present invention generally describing Steps 1 to 3.
Figure 2:
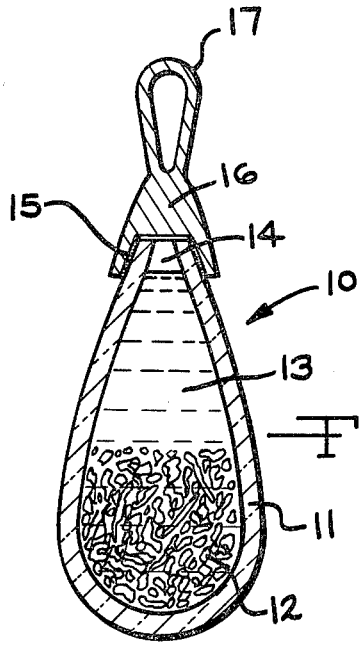
FIG. 2 is a front cross-sectional view of a pendant particularly illustrating the construction.
Figure 3:
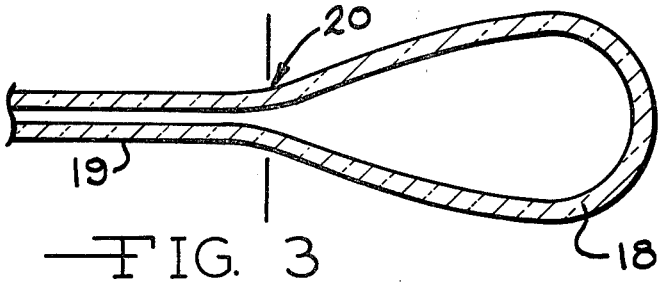
FIGS. 3, 4, 5 and 6 illustrate the preferred method for the fabrication of the pendant of FIG. 2.
Figure 4:
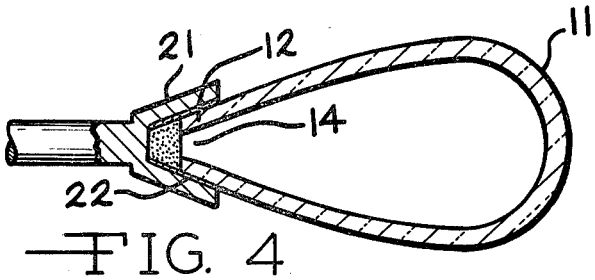
Figure 5:
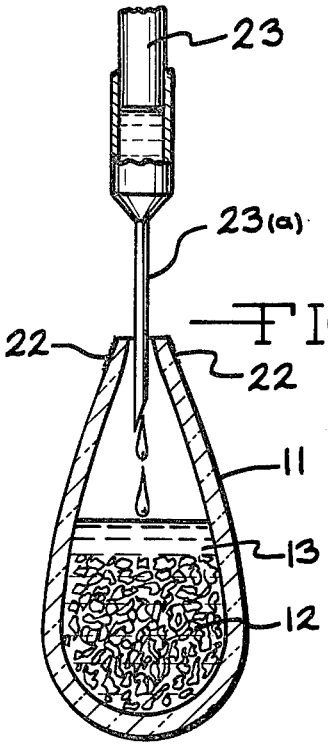
Figure 6:
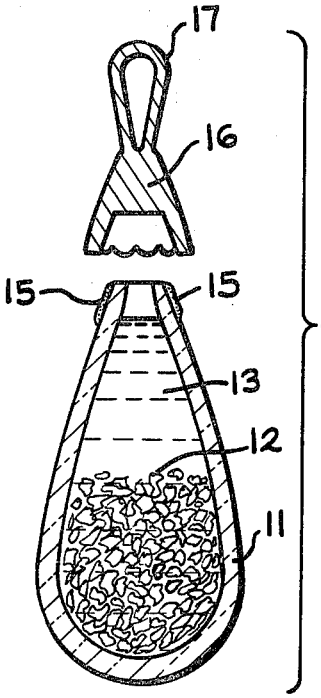
Figure 7:
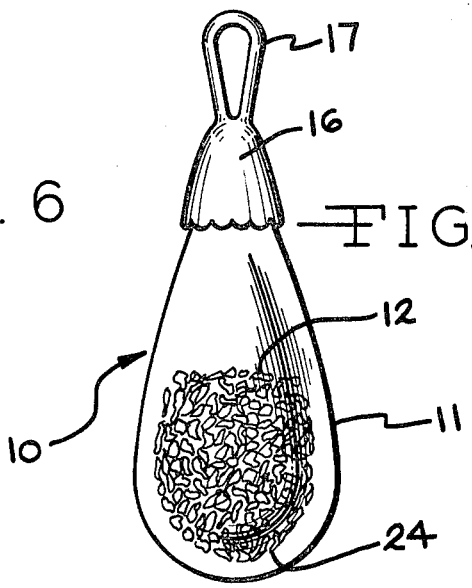
FIG. 7 is a front view of the pendant as it appears after fabrication.

The fabrication of a pendant 10 by the preferred method is shown in FIGS. 2 to 6. The pendant 10 of FIG. 2 includes a glass envelope 11 with particles or flakes of a metal or mineral 12 inside the envelope 11 suspended in the liquid 13. An air space in the opening 14 is present above the liquid 13. A resin or other bonding agent 15 bonds a cap 16 with an attachment means or loop 17. FIG. 3 shows a tear shaped extension 18 of a tube 19 which is cut from the tube 19 to form a truncated conical portion with an opening in the envelope 11 as indicated at 20. The extension 18 is formed by heat sealing an end of tube 19 and then blowing with heating as is well known to those skilled in the art. The glass envelope 11 can be shaped out of borosilicate, soda lime or lead glasses for instance and is preferably clear. The extension 18 forms the envelope 11 upon cutting at 20. As shown in FIG. 4, grinding with the inside of a cone shaped rotating stone 21 around the opening 14 is used in order to provide an abraded surface 22. This surface 22 is used for bonding of the cap 16. A liquid 13 is injected by means of a needle **23*a* on a syringe 23 inside the envelope 11 provided with the particulate metals or minerals 12 and fills the envelope 11 leaving the air pocket adjacent the opening 14, as shown in FIGS. 5 and 6. A resin 15, such as an epoxy resin is applied to the ground surface 22, the cap 16 is fitted to the envelope 11, and the resin 15 cured. Standard 10°, 14° or 18° inside taper caps 16 can be used. The result is a pendant 10 wherein the bottom inside line 24 of the envelope 11 is barely visible with the naked eye and then only in front view as shown in FIG. 7**.

The present invention has been used to provide 24 carat gold leaf in small chips as the metal 12 inside the envelope 11 which provides a striking piece of jewelry since the tear drop shape of the envelope 11 and the liquid 13 magnifies the chips as well as providing a clear golden appearance. In a like manner silver, opals, cut diamonds and rubies were used with excellent effect. It was found that because of the ground glass surface 22, the air pocket adjacent the opening 14 and the use of the epoxy resin 15 that there was no leakage of the liquid 13 and even at extremes of temperature.

The foregoing invention is preferably used to make jewelry; however, it will be appreciated that many different kinds of decorative objects such as paper weights can be made by the method of the invention.

I claim:

1. The method for the fabrication of a decorative object which comprises:

(a) providing a hollow clear glass envelope having a decorative portion and having a truncated conical portion with an opening remote from the decorative portion;

(b) grinding the conical portion of the envelope outside of the opening with a conically shaped rotatable grinder which fits over the conical portion in order to provide a ground surface around the opening;

(c) injecting a liquid comprising glycerine and clear miscible solvents for glycerine with visible particles therein inside the envelope through the opening without wetting the opening in an amount which leaves only a small gas pocket in the envelope adjacent the opening and above the liquid wherein the index of refraction of the liquid visually approximates that of the glass and wherein the particles appear to float upon agitation in the liquid; and (d) bonding a cap over the opening on the ground surface with a resin which is impervious to the liquid with the gas pocket adjacent the opening in order to seal the liquid in the decorative object.

2. The method of claim 1 wherein the envelope is formed by blowing a closed heated glass tube to form a tear shaped envelope with a rounded decorative portion and wherein the conical portion with the opening is formed by cutting the tube from the tear shaped envelope.

3. The method of claim 1 wherein the liquid is a mixture of glycerine, water and ethyl alcohol.

4. The method of claim 1 wherein the decorative object is jewelry and wherein the cap over the opening has a jewelry attachment means.

5. The method of claim 1 wherein the cap is bonded over the opening on the ground surface with an epoxy resin.

6. The method of claim 1 wherein the decorative object is a pendant or an earring.

7. The method of claim 1 wherein a flaked mineral is provided in the liquid.

8. The method of claim 7 wherein the flaked mineral is selected from gold, silver or mixtures thereof.

9. The decorative object which comprises:

(a) a hollow transparent glass envelope with a decorative portion and having an opening with a roughened surface outside of and surrounding the opening remote from the decorative portion;

(b) a viscous liquid provided inside the envelope in an amount which leaves a small gas pocket in the envelope with visible particles contained in said liquid, wherein the particles appear to float upon agitation; and (c) a cap sealed over and bonded to the roughened surface surrounding the opening with a resin which is impervious to the liquid, thereby sealing said liquid in said decorative object.

10. The decorative object of claim 9 wherein the envelope is tear shaped and smooth with a rounded portion of the tear as the decorative portion opposite the opening.

11. The decorative object of claim 10 as jewelry with an attachment means on the cap over the opening.

12. The decorative object of claim 9 wherein a flaked mineral is provided inside the envelope in the liquid.

13. The decorative object of claim 10 wherein the flaked mineral is selected from gold, silver or mixtures thereof.

14. The decorative object of claim 9 as jewelry with an attachment means on the cap and wherein a flaked metal is provided inside the envelope in the liquid.

15. The decorative object of claim 14 wherein the envelope is tear shaped with a rounded end opposite the opening as the decorative portion and is a pendant or an earring.

16. The decorative object of claim 14 wherein the liquid comprises glycerine or glycerine and a liquid which is miscible with glycerine.

17. The method for the fabrication of a decorative object which comprises:

(a) providing a hollow transparent glass envelope having a decorative portion and an opening, said envelope having an external wall with a roughened surface thereon surrounding the opening remote from the decorative portion;

(b) providing a viscous liquid with visible particles and placing said liquid inside the envelope through the opening without wetting the opening in an amount which leaves only a small gas pocket in the envelope adjacent the opening and above the liquid wherein the particles appear to float upon agitation in the liquid; and (c) bonding a cap over the opening on the roughened surface with the gas pocket adjacent the opening with a resin which is impervious to the liquid, thereby sealing said liquid within the decorative object.

* * * * *